US010368615B2

(12) United States Patent
Zhang

(10) Patent No.: US 10,368,615 B2
(45) Date of Patent: Aug. 6, 2019

(54) HARNESS FASTENING SYSTEM

(71) Applicant: Wonderland Nurserygoods Company Limited, Tuen Mun, N.T. (HK)

(72) Inventor: Zhongjie Zhang, Guangdong (CN)

(73) Assignee: WONDERLAND NURSERYGOODS COMPANY LIMITED, Tuen Mun, N.T. (HK)

( * ) Notice: Subject to any disclaimer, the term of this patent is extended or adjusted under 35 U.S.C. 154(b) by 0 days.

(21) Appl. No.: 15/805,364

(22) Filed: Nov. 7, 2017

(65) Prior Publication Data

US 2018/0125171 A1 May 10, 2018

(30) Foreign Application Priority Data

Nov. 8, 2016 (CN) ..... 2016 1 0982304

(51) Int. Cl.
*A44B 11/25* (2006.01)
*A47D 13/02* (2006.01)
*A44B 11/26* (2006.01)

(52) U.S. Cl.
CPC ..... *A44B 11/2519* (2013.01); *A44B 11/2592* (2013.01); *A44B 11/266* (2013.01); *A47D 13/02* (2013.01)

(58) Field of Classification Search
CPC ..... A44B 11/2519; A44B 11/2592; A44B 11/266; A47D 13/02
See application file for complete search history.

(56) References Cited

U.S. PATENT DOCUMENTS 3,605,207 A * 9/1971 Glauser ..... A44B 11/2511 24/632
4,660,260 A * 4/1987 Ishiguro ..... A44B 11/2511 24/637

(Continued)

FOREIGN PATENT DOCUMENTS

EP 2392503 A1 12/2011
JP H0615509 U 3/1994

(Continued)

OTHER PUBLICATIONS

The Search Report in co-pending EP Patent Application No. 17200386.5 dated Feb. 13, 2018.

(Continued)

*Primary Examiner* — Robert Sandy
*Assistant Examiner* — David M Upchurch
(74) *Attorney, Agent, or Firm* — Baker & McKenzie LLP

(57) ABSTRACT

A harness fastening system includes a first strap fastener, and a second strap fastener attachable to and detachable from the first strap fastener. The second strap fastener includes a casing body, a tongue and a release actuator. The casing body has an opening for passage of the first strap fastener. The tongue is disposed in the casing body, and includes a support base and at least one locking portion connected with each other, the support base being further connected with the casing body, and the locking portion being elastically deflectable relative to the support base for engaging and disengaging the first strap fastener. The release actuator is movably assembled with the casing body, and is operable to urge the locking portion to elastically deflect for disengaging from the first strap fastener.

20 Claims, 10 Drawing Sheets

(56) References Cited

U.S. PATENT DOCUMENTS

| | | | | |
|---|---|---|---|---|
| 4,843,688 | A * | 7/1989 | Ikeda | A44B 11/12 24/170 |
| 5,839,175 | A | 11/1998 | Lin | |
| 6,560,830 | B1 * | 5/2003 | Chi | A44B 11/266 24/616 |
| 8,464,402 | B2 * | 6/2013 | Mamie | B60P 7/0823 24/170 |
| 2004/0255439 | A1 * | 12/2004 | Benedict | A44B 11/2519 24/640 |
| 2009/0094809 | A1 | 4/2009 | Kung | |
| 2010/0011542 | A1 * | 1/2010 | Badrenas Buscart | A44B 11/266 24/163 R |

FOREIGN PATENT DOCUMENTS

| | | | |
|---|---|---|---|
| JP | 10-337206 | A | 12/1998 |
| JP | 2010-213936 | A | 9/2010 |
| JP | 2011-251121 | A | 12/2011 |

OTHER PUBLICATIONS

An Office Action issued by the Japan Patent Office dated Feb. 19, 2019 in connection with Japanese patent application No. 2017-214677.

* cited by examiner

HARNESS FASTENING SYSTEM

CROSS-REFERENCE TO RELATED APPLICATION(S)

This application respectively claims priority to Chinese Patent Application No. 201610982304.1 filed on Nov. 8, 2016, which is incorporated herein by reference.

BACKGROUND

1. Field of the Invention

The present invention relates to harness fastening systems.

2. Description of the Related Art

Some infant carrier products can typically allow a parent to carry a small infant close to the parent's body without using the hands. The infant carrier can typically have a harness comprised of multiple strap portions that have to be properly wrapped and attached around the parent's body to ensure that an infant received in the infant carrier can be securely restrained and would not fall. Such infant carriers may need a fastening system that is convenient to operate and can securely attach the harness straps.

Therefore, there is a need for an improved harness fastening system that can be manufactured in a cost-effective manner, and address at least the foregoing issues.

SUMMARY

The present application describes a harness fastening system comprising a first strap fastener and a second strap fastener attachable to and detachable from the first strap fastener. The second strap fastener comprises a casing body, a tongue and a release actuator. The casing body has an opening for passage of the first strap fastener. The tongue is disposed in the casing body, and comprises a support base and at least one locking portion connected with each other, the support base being further connected with the casing body, and the locking portion being elastically deflectable relative to the support base for engaging and disengaging the first strap fastener, the locking portion being engaged with the first strap fastener when the first and second strap fasteners are attached to each other, and the locking portion being disengaged from the first strap fastener when the first strap fastener is detached from the second strap fastener. The release actuator is movably assembled with the casing body, and is operable to urge the locking portion to elastically deflect for disengaging from the first strap fastener.

DETAILED DESCRIPTION OF THE EMBODIMENTS

Figure 1:
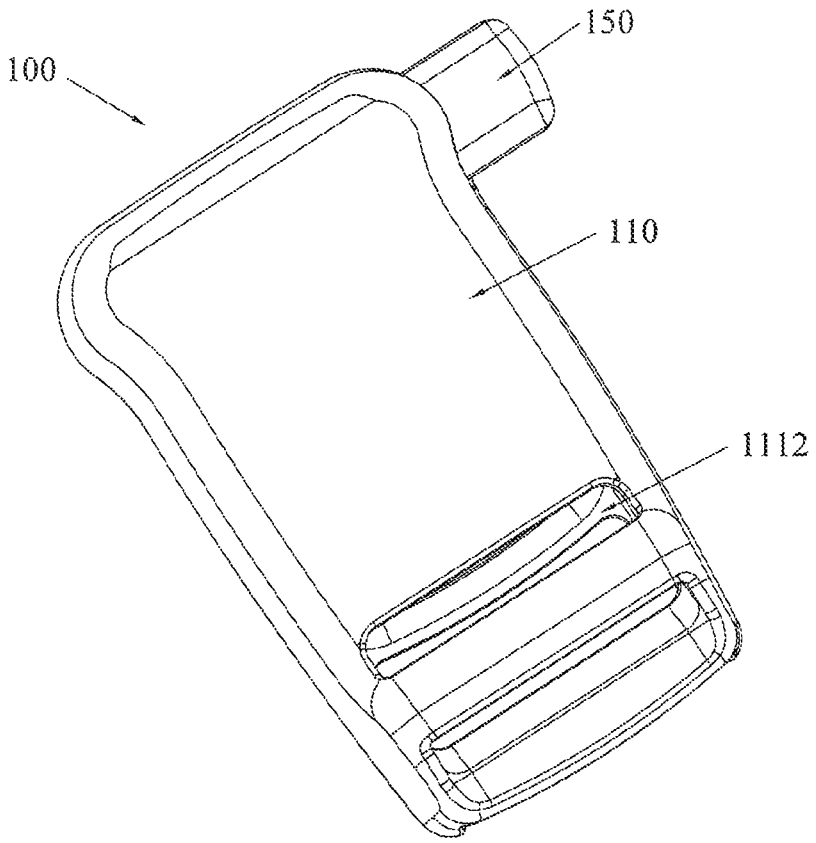
FIG. 1 is a perspective view illustrating an embodiment of a harness fastening system comprised of two strap fasteners attached to each other.
Figure 2:
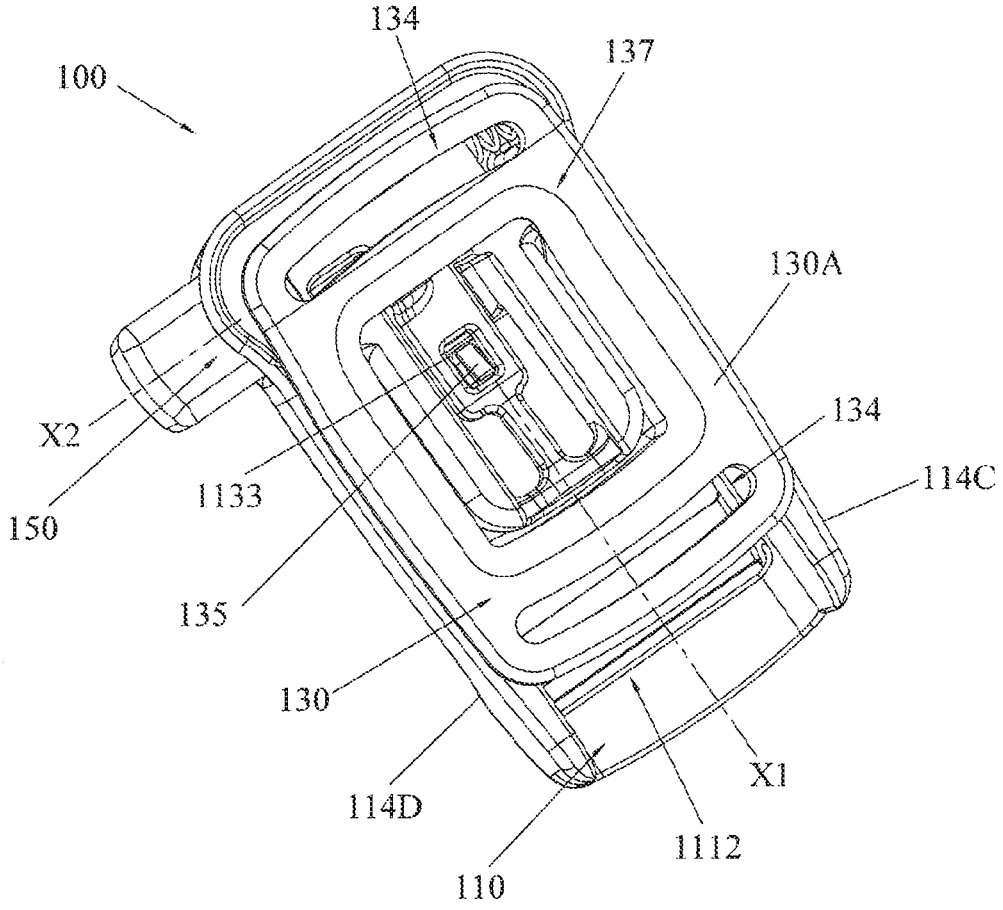
FIG. 2 is a perspective view illustrating the harness fastening system from an opposite side to that shown in FIG. 1.

FIGS. 1-5 illustrate an embodiment of a harness fastening system 100. Referring to FIGS. 1-5, the harness fastening mechanism 100 includes two strap fasteners 110 and 130. For example, the strap fastener 110 can be a male strap fastener, and the strap fastener 130 can be a female strap fastener. The strap fasteners 110 and 130 can be respectively connected with different strap portions, and are attachable to and detachable from each other to fasten or unfasten the harness fastening system 100. Examples of implementation for the harness fastening system 100 can include, without limitation, infant carriers used for carrying an infant against a caregiver's body with the strap fasteners 110 and 130 attaching different strap portions of the infant carrier.

Figure 3:
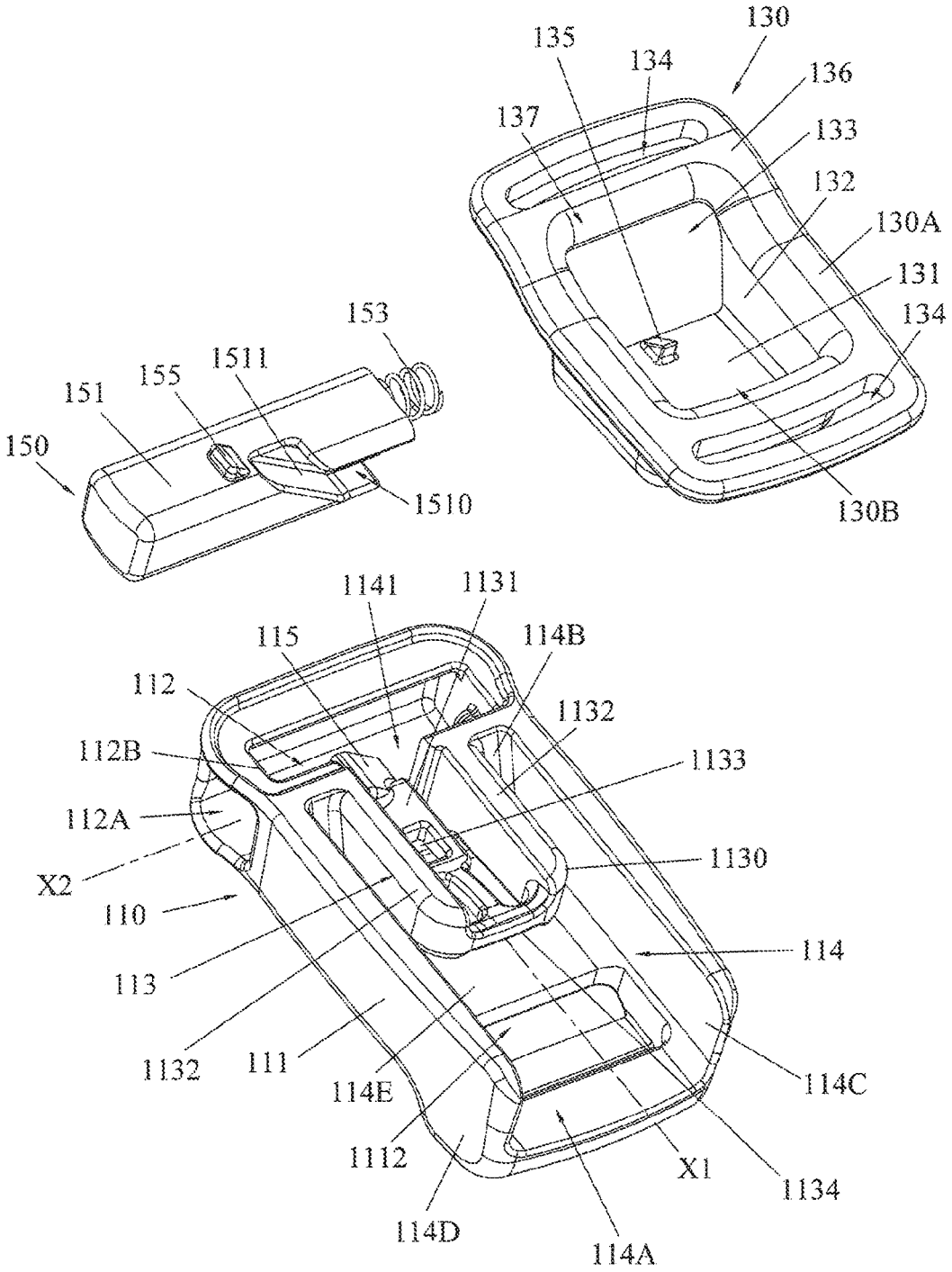
FIG. 3 is an exploded view illustrating some construction details of the harness fastening system shown in FIG. 1.
Figure 4:
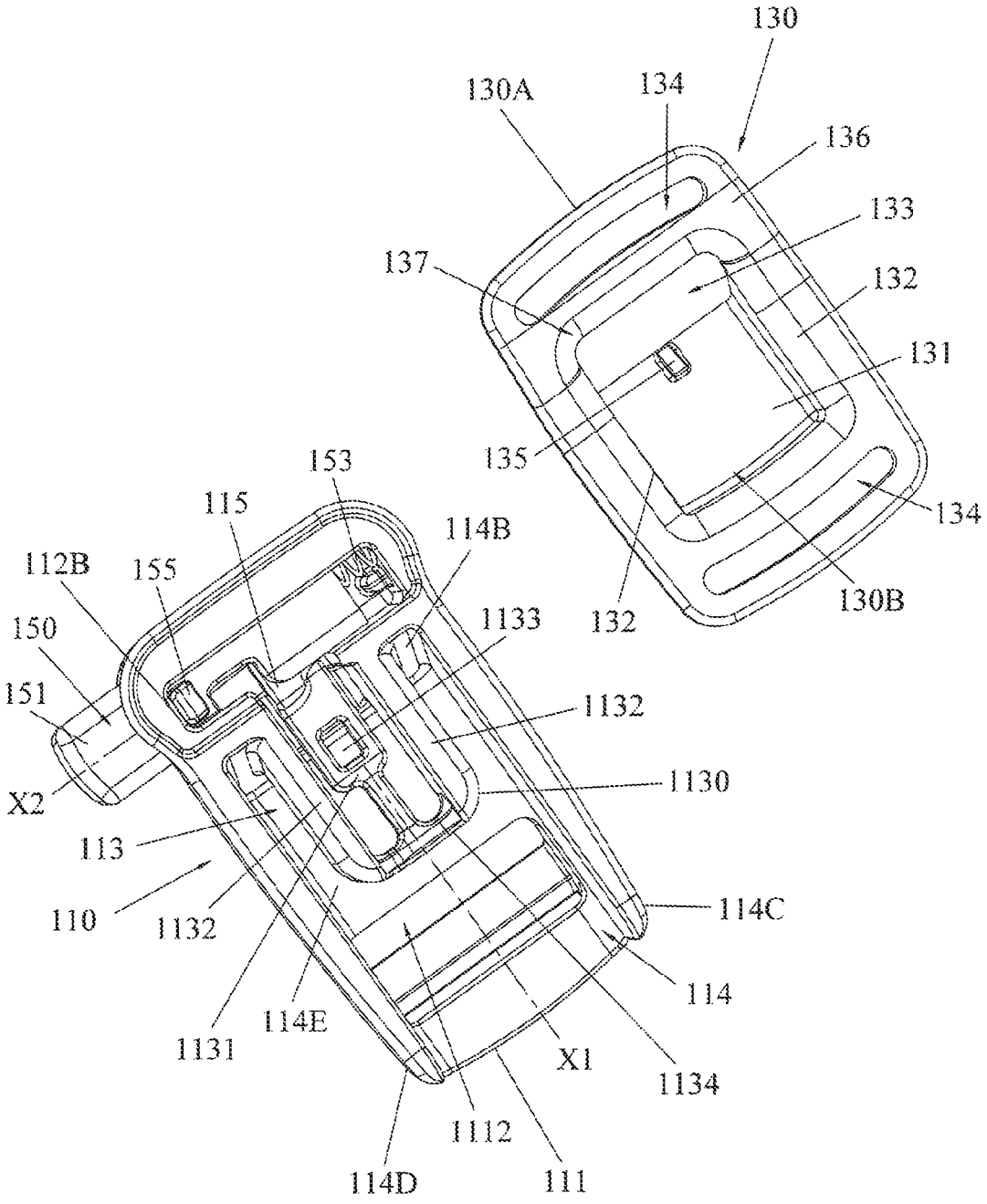
FIG. 4 is perspective view illustrating the two strap fasteners of the harness fastening system shown in FIG. 1 detached from each other.
Figure 5:
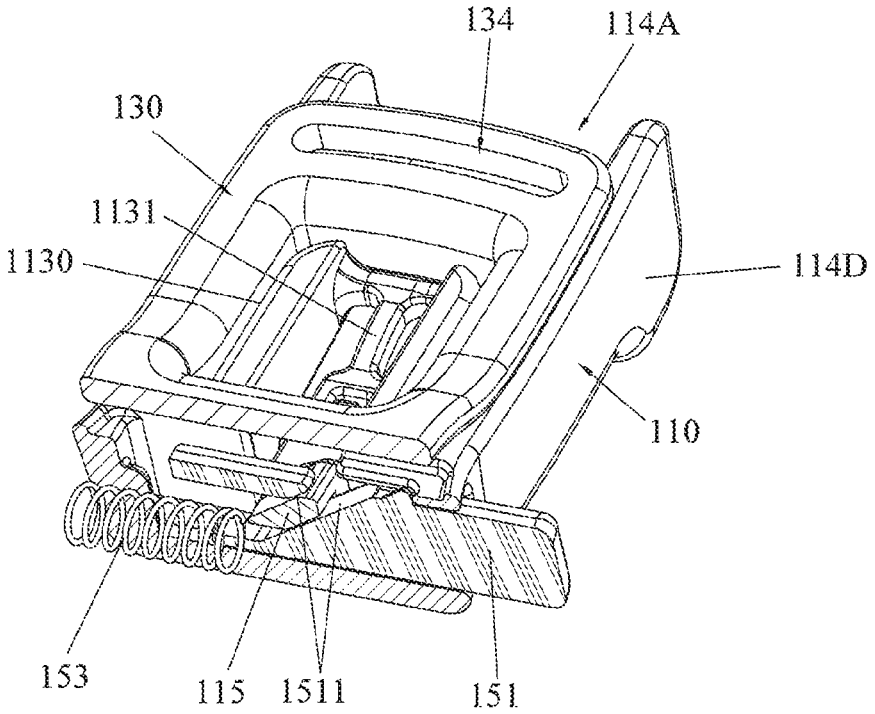
FIG. 5 is a cross-sectional view of the harness fastening system shown in FIG. 1.
Figure 6:
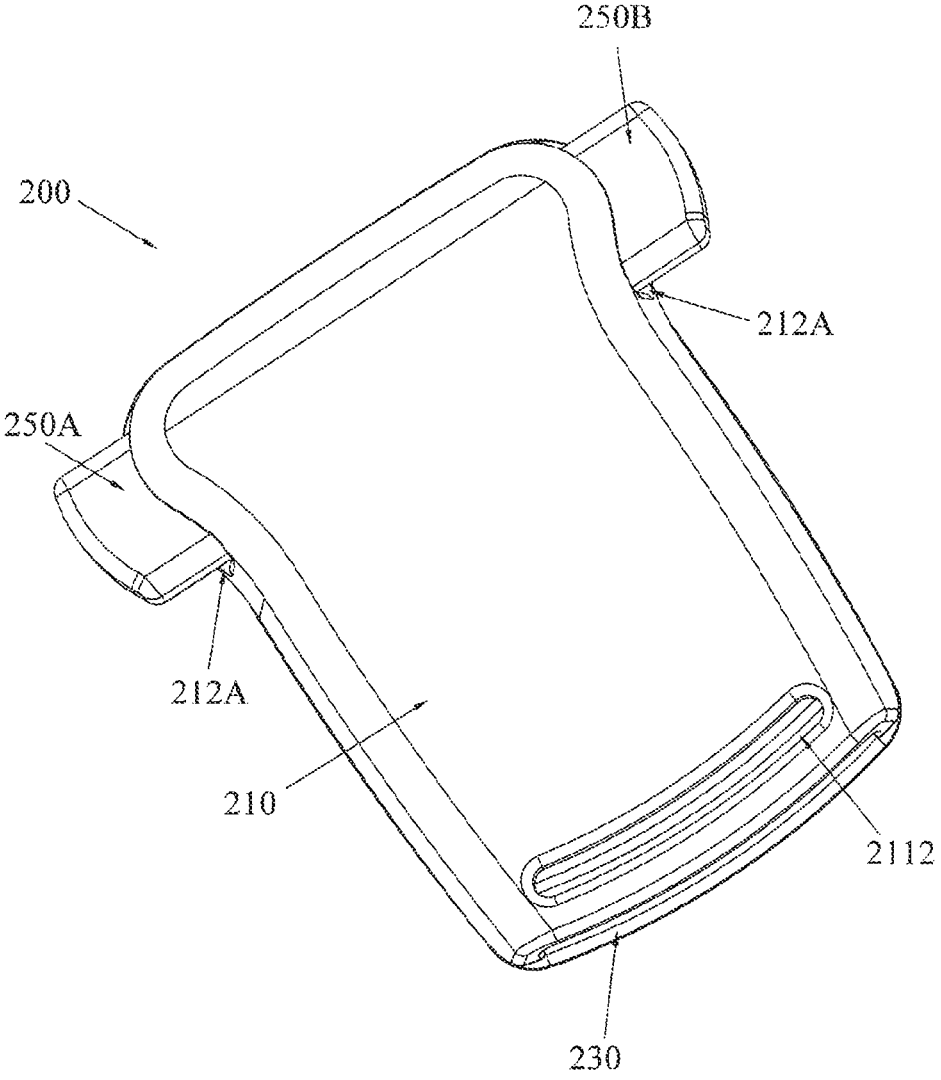
FIG. 6 is a perspective view illustrating another embodiment of a harness fastening system comprised of two strap fasteners attached to each other.
Figure 7:
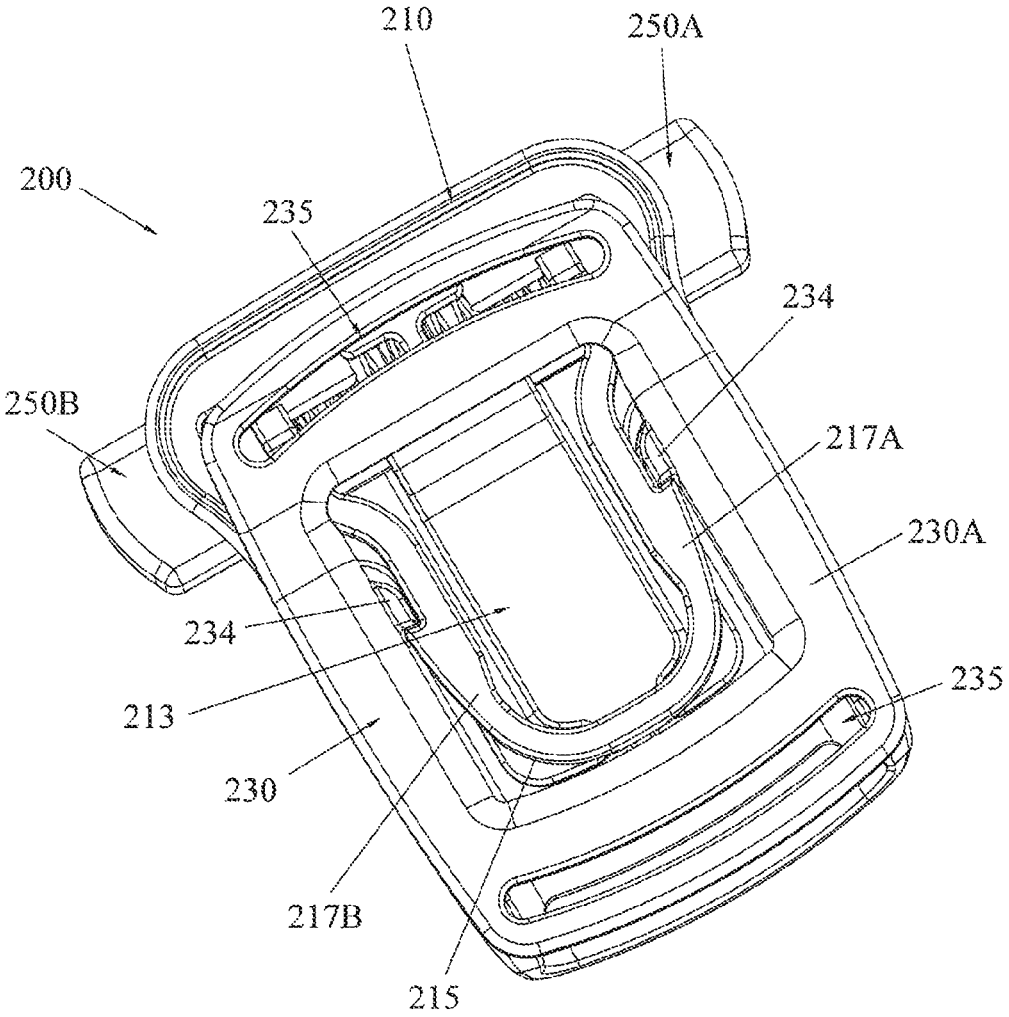
FIG. 7 is a perspective view illustrating the harness fastening system of FIG. 6 from an opposite side to that shown in FIG. 6.

Referring to FIGS. 3-5, the strap fastener 110 includes a casing body 111, a tongue 113, a release actuator 150 and a spring 153. The casing body 111 can have two inner cavities 112 and 114 contiguous to each other. The inner cavity 114 can extend along an axis X1, and can be axially connected with an opening 114A at an end of the casing body 111. According to an example of construction, the inner cavity 114 can be at least partially delimited by a plurality of sidewalls 114B, 114C, 114D and 114E of the casing body 111. The sidewall 114B can axially face the opening 114A along the axis X1, and can at least partially separate the inner cavities 112 and 114 from each other. The two opposite sidewalls 114C and 114D can be respectively connected with two opposite ends of the sidewall 114B and extend from the sidewall 114B to the opening 114A, a width of the opening 114A being defined between the two opposite sidewalls 114C and 114D. The sidewall 114E can be respectively connected with the sidewalls 114B, 114C and 114D, and can extend between the two sidewalls 114B and 114C from the sidewall 114B to the opening 114A. The inner cavity 114 is adapted to receive at least partially the strap fastener 130, which can slide generally along the axis X1 through the opening 114A into the inner cavity 114 for engagement with the tongue 113.

Referring to FIGS. 3 and 4, the tongue 113 is placed in the inner cavity 114, and is connected with the casing body 111. More specifically, the tongue 113 can be connected with the sidewall 114B of the casing body 111, and can extend generally along the axis X1 from the sidewall 114B toward the opening 114A. According to an example of construction, the tongue 113 can include a support base 1130 connected with the casing body 111, and a locking portion 1131 connected with the support base 1130.

The support base 1130 can be connected with the sidewall 114B, and can extend from the sidewall 114B along the axis X1 toward the opening 114A. According to an example of construction, the support base 1130 can include two side portions 1132 and a transversal portion 1134. The two side portions 1132 can be respectively connected with the sidewall 114B, and can extend generally parallel and spaced apart from each other along the axis X1 toward the opening 114A. The transversal portion 1134 can extend between and connect with the two side portions 1132 at an end of the support base 1130 distant from the sidewall 114B.

The locking portion 1131 can be connected with the transversal portion 1134 of the support base 1130 at the end of the support base 1130 distant from the sidewall 114B, and can extend between the two side portions 1132 of the support base 1130. In particular, the locking portion 1131 can extend along the axis X1 past the sidewall 114B into the inner cavity 112 through an opening 1141 provided in the sidewall 114B. The locking portion 1131 may terminate into a free end 115 that is at least partially positioned in the inner cavity 112. A gap may be defined between the locking portion 1131 and each of the two side portions 1132 along the axis X1, this gap extending along the axis X1 from the connection of the locking portion 1131 with the transversal portion 1134 of the support base 1130 to the free end 115 of the locking portion 1131. Moreover, a gap can be defined between each of the sidewalls 114C, 114D and 114E of the casing body 111 and the tongue 113 comprised of the locking portion 1131 and the support base 1130. Accordingly, the locking portion 1131 of the tongue 113 can elastically deflect relative to the support base 1130 toward and away the sidewall 114E of the casing body 111 for engaging and disengaging the strap fastener 130.

Referring to FIGS. 3 and 4, the locking portion 1131 may further include an opening 1133 located between the free end 115 and the transversal portion 1134 along the axis X1. The opening 1133 may be positioned centrally on the locking portion 1131, and can receive the engagement of the strap fastener 130. According to an example of construction, the opening 1133 may include one or more bevel for facilitating the engagement and/or disengagement of the strap fastener 130 with respect to the locking portion 1131.

According to an example of implementation, the tongue 113 comprised of the support base 1130 and the locking portion 1131 may be formed integrally as a single part that is connected with the casing body 111. According to an example of implementation, the casing body 111, and the tongue 113 comprised of the support base 1130 and the locking portion 1131, may be formed integrally as a single part.

Referring to FIGS. 3 and 4, the casing body 111 can further include a strap slot 1112 through which a strap portion may be wrapped and anchored to the strap fastener 110. The strap slot 1112 may be placed adjacent to the opening 114A of the casing body 111.

Referring to FIGS. 3-5, the release actuator 150 may be provided as a release button 151. The release actuator 150 can be received at least partially in the inner cavity 112 of the casing body 111, and can be exposed for operation through an opening 112A of the casing body 111 at a side of the sidewall 114D. For convenient access and operation, the release actuator 150 may be exemplary disposed adjacent to an end of the casing body 111 that is opposite to that where is provided the opening 114A. The release actuator 150 is movably assembled with the casing body 111, and can contact and push against the free end 115 of the locking portion 1131 so as to urge the locking portion 1131 to deflect and disengage from the strap fastener 130.

According to an example of construction, the release actuator 150 may be assembled with the casing body 111 for sliding along an axis X2, and can include a guide slot 1510 in which the free end 115 of the locking portion 1131 can be slidably received. The axis X2 of movement of the release actuator 150 can be substantially perpendicular to the axis X1. The guide slot 1510 in the release actuator 150 may have an inclined portion delimited at least partially by two generally parallel ramp surfaces 1511 that are titled an angle relative to the axis X2. During operation, the release actuator 150 is movable along the axis X2 to cause the locking portion 1131 of the tongue 113 to elastically deflect relative to the support base 1130 toward or away from the sidewall 114E via a sliding contact between the free end 115 of the locking portion 1131 and at least one of the two ramp surfaces 1511. According to some example of construction, the free end 115 of the locking portion 1131 may also have ramp surfaces for facilitating the sliding contact between the free end 115 and the release actuator 150.

The spring 153 can be respectively connected with the release actuator 150 and a sidewall of the inner cavity 112. The spring 153 can bias the release actuator 150 for protruding outward at a side of the sidewall 114D. The release actuator 150 can have a stop rib 155 that can contact against an edge 112B of the inner cavity 112 to stop the release actuator 150 in position against the biasing force applied by the spring 153.

Referring to FIGS. 3 and 4, the strap fastener 130 can be formed integrally as a unitary part. According to an example of construction, the strap fastener 130 can include a support frame 130A having a receiving cavity 130B. The receiving cavity 130B can be delimited at least partially by a bottom plate 131 and a plurality of sidewalls 132 projecting from the bottom plate 131, and can be respectively opened at a side of the strap fastener 130 via an insert hole 133 and on a surface 136 of the support frame 130A via an opening 137. The tongue 113 of the strap fastener 110 can be inserted into the receiving cavity 130B via the insert hole 133 with the bottom plate 131 of the strap fastener 130 restrictedly positioned between the tongue 113 and the sidewall 114E of the strap fastener 110. Moreover, the bottom plate 131 can have a protrusion 135 adapted to engage with the opening 1133 of the locking portion 1131 for locking the strap fastener 110 with the strap fastener 130. The protrusion 135 can have any suitable shapes, e.g., rectangular shape, a square shape, a cylindrical shape, etc. Moreover, the protrusion 135 can have a ramp surface for facilitating the insertion or removal of the tongue 113 of the strap fastener 110: the ramp surface on the protrusion 135 may be in sliding contact with the locking portion 1131 as the tongue 113 slides into or out of the receiving cavity 130B.

Referring to FIGS. 3 and 4, the support frame 130A can further include two strap slots 134 through which two strap portions may be respectively wrapped and anchored with the strap fastener 130. The two strap slots 134 can be disposed at two opposite sides of the receiving cavity 130B.

Exemplary operation of the harness fastening system 100 is described hereinafter with reference to FIGS. 1-5. For attaching the strap fastener 110 to the strap fastener 130, the tongue 113 of the strap fastener 110 can be inserted through the insert hole 133 into the receiving cavity 130B of the strap fastener 130. As the tongue 113 slides into the receiving cavity 130B, the bottom plate 131 of the strap fastener 130 can be positioned between the tongue 113 and the sidewall 114E of the strap fastener 110, and the protrusion 135 on the bottom plate 131 can push the locking portion 1131 of the tongue 113 away from the sidewall 114E. Once the opening 1133 reaches the protrusion 135, the locking portion 1131 can elastically deflect toward the sidewall 114E so that the protrusion 135 engages the opening 1133 for locking the strap fastener 110 with the strap fastener 130. Owing to the biasing force of the spring 153, the release actuator 150 can protrude outward at a side of the strap fastener 110 when the strap fasteners 110 and 130 are attached to each other. After the strap fasteners 110 and 130 are attached to each other, the strap slot 1112 of the strap fastener 110 and the two strap slots 134 of the strap fastener 130 can be positioned along the same axis X1. Moreover, the support frame 130A of the strap fastener 130 can at least partially cover the inner cavity 114 of the strap fastener 110 and stretch over the two sidewalls 114C and 114D of the casing body 111.

For detaching the strap fastener 110 from the strap fastener 130, a user can push the release actuator 150 inward against the biasing force of the spring 153. Owing to the sliding contact between the ramp surface 1511 of the release actuator 150 and the free end 115 of the locking portion 1131, the release actuator 150 can accordingly urge the locking portion 1131 of the tongue 113 to deflect away from the sidewall 114E of the casing body 111 and thereby disengage the protrusion 135 from the opening 1133. The strap fasteners 110 and 130 can be thereby unlocked and pulled away from each other.

FIGS. 6-10 are schematic views illustrating another embodiment of a harness fastening system 200. Referring to FIGS. 6-10, the harness fastening mechanism 200 includes two strap fasteners 210 and 230. For example, the strap fastener 210 can be a male strap fastener, and the strap fastener 230 can be a female strap fastener. The strap fasteners 210 and 230 can be respectively connected with different strap portions, and are operable to engage or disengage with respect to each other to fasten or unfasten the harness fastening system 200.

Figure 8:
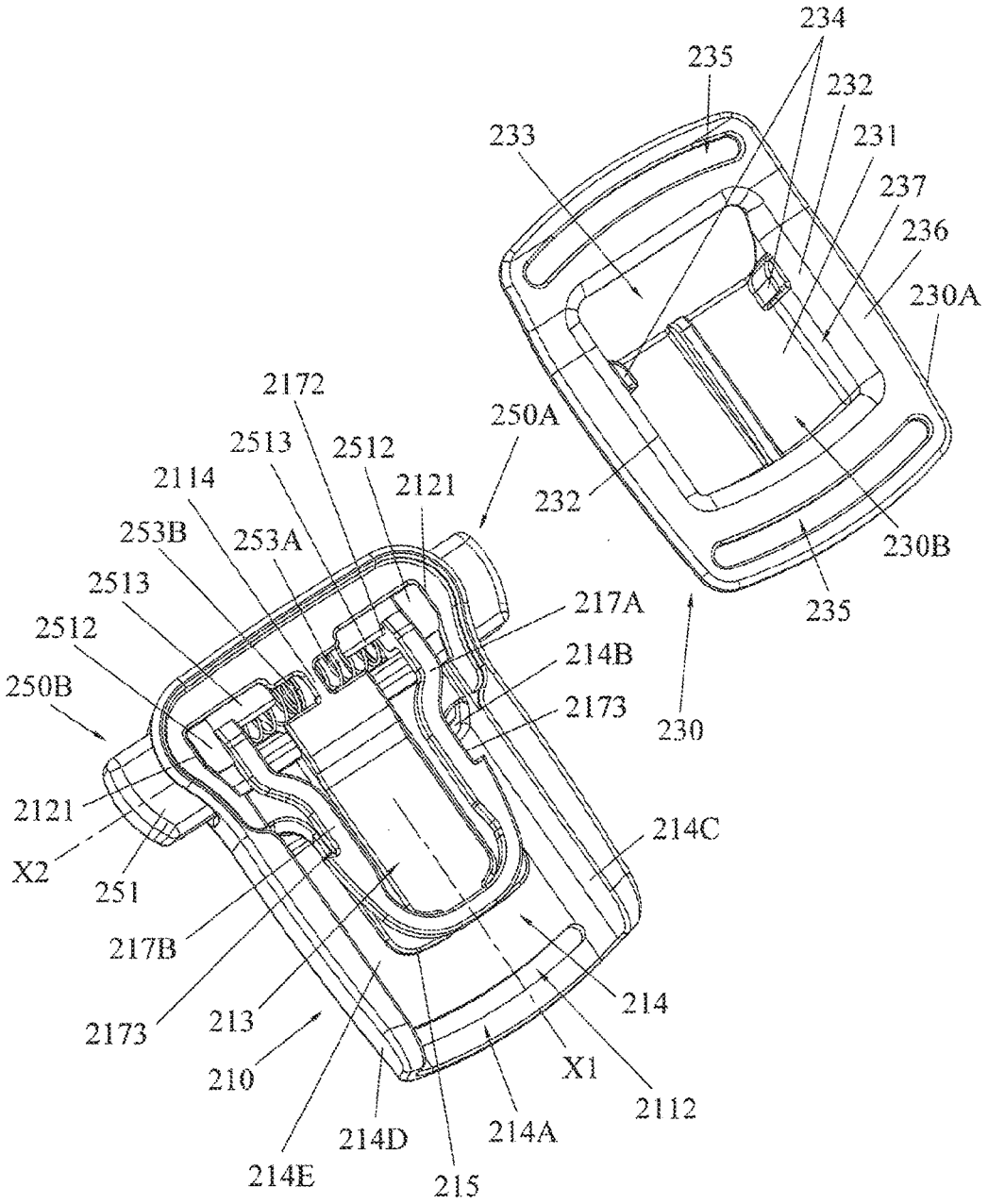
FIG. 8 is a perspective view illustrating the two strap fasteners of the harness fastening system shown in FIG. 6 detached from each other.
Figure 9:
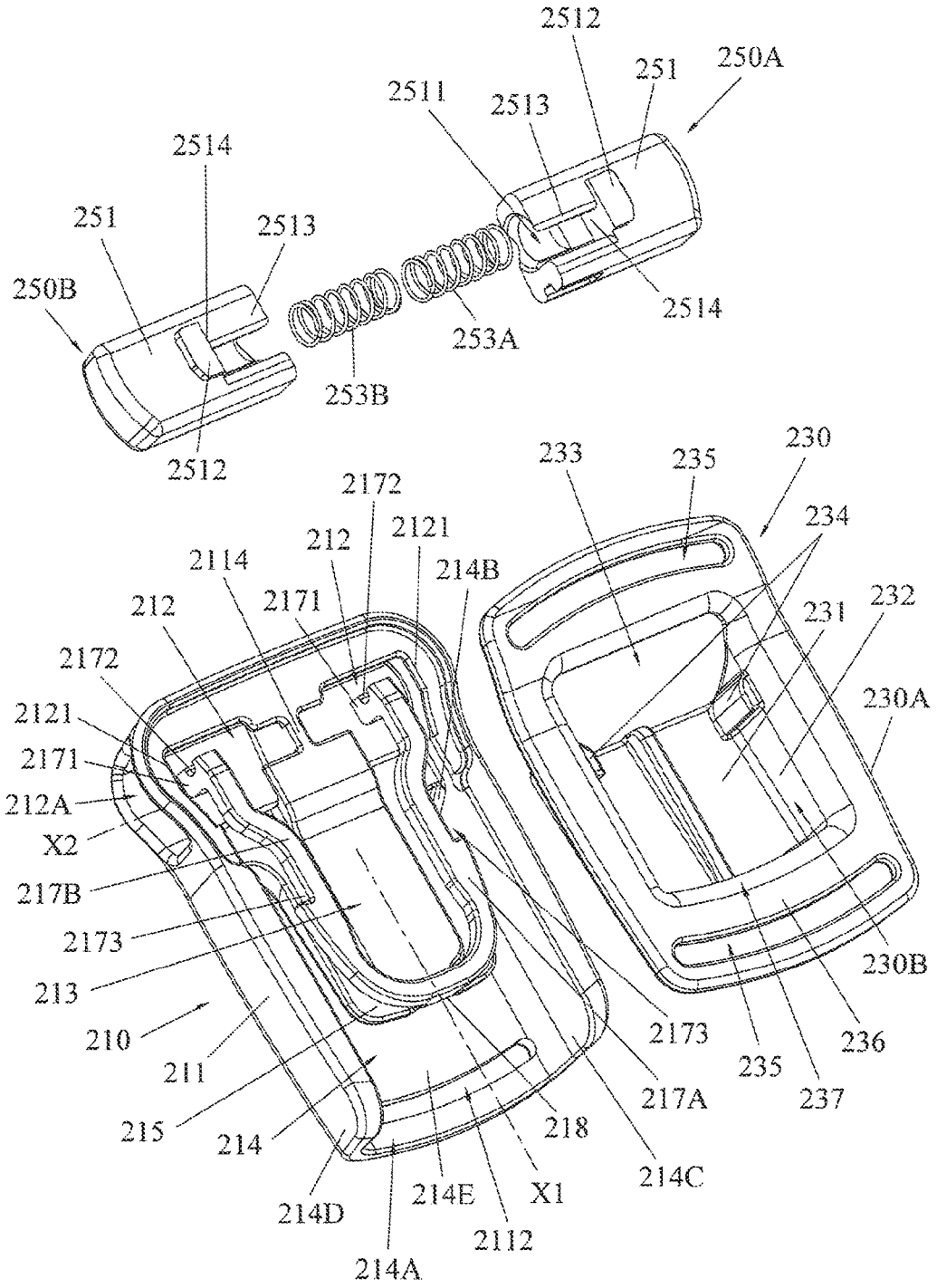
FIG. 9 is an exploded view illustrating some construction details of the harness fastening system shown in FIG. 6.
Figure 10:
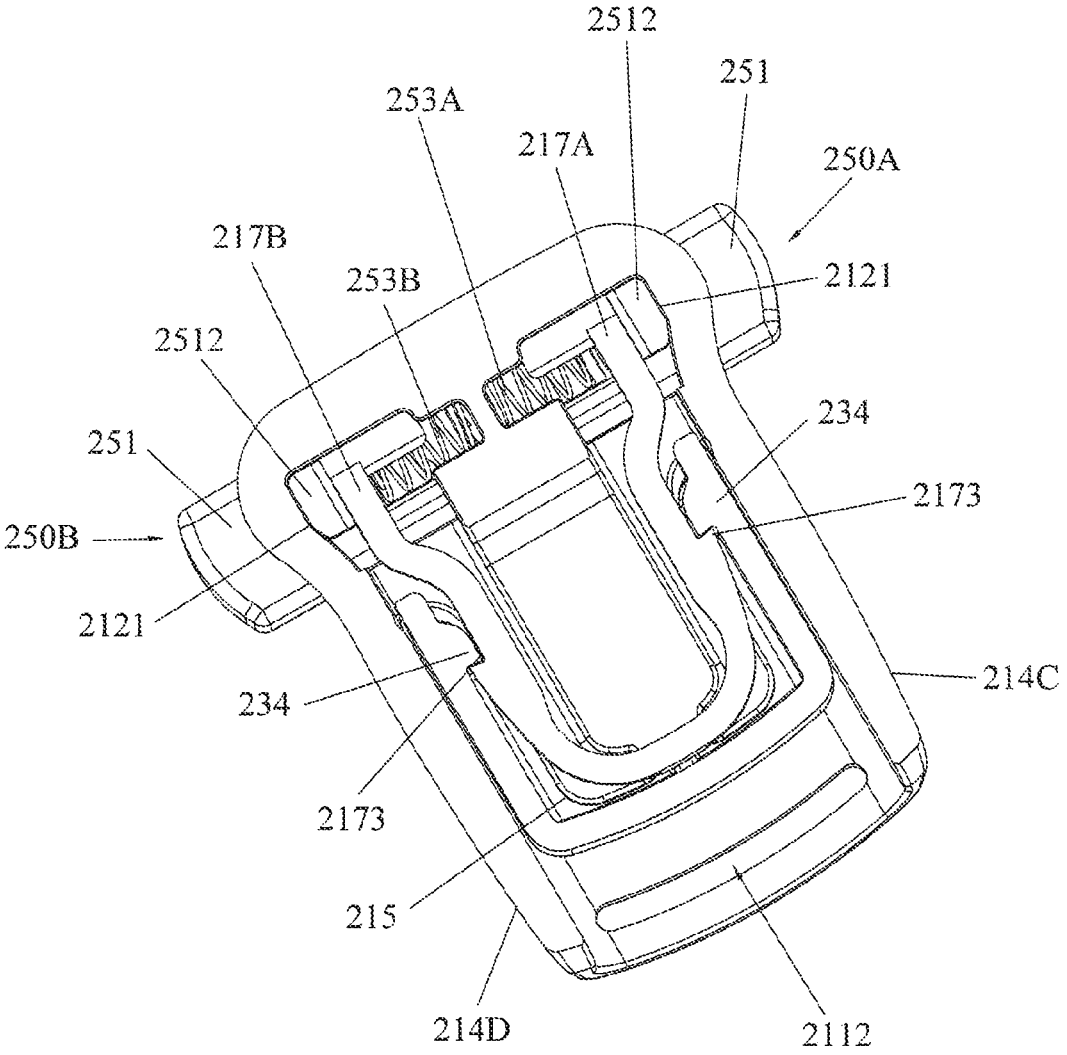
FIG. 10 is a schematic view illustrating a locking engagement between the two strap fasteners of the harness fastening system shown in FIG. 6.

Referring to FIGS. 8 and 9, the strap fastener 210 can include a casing body 211, a tongue 213, two release actuator 250A and 250B, and two springs 253A and 253B. The casing body 211 can have a plurality of inner cavities 212 and 214 disposed contiguous to one another. The inner cavity 214 can extend along an axis X1, and can be axially connected with an opening 214A at an end of the casing body 211. According to an example of construction, the inner cavity 214 can be at least partially delimited by a plurality of sidewalls 214B, 214C, 214D and 214E of the casing body 211. The sidewall 214B can axially face the opening 214A along the axis X1, and can at least partially separate the inner cavity 214 from the two inner cavities 212. The two opposite sidewalls 214C and 214D can be respectively connected with two opposite ends of the sidewall 214B, and extend from the sidewall 214B to the opening 214A, a width of the opening 214A being defined between the two sidewalls 214C and 214D. The sidewall 214E can be respectively connected with the sidewalls 214B, 214C and 214D, and can extend between the two sidewalls 214B and 214C from the sidewall 214B to the opening 214A. The inner cavity 214 is adapted to receive at least partially the strap fastener 230, which can slide generally along the axis X1 through the opening 214A into the inner cavity 214 for engagement with the tongue 213.

Referring to FIGS. 8 and 9, the tongue 213 is placed in the inner cavity 214, and is connected with the casing body 211. More specifically, the tongue 213 can be connected with the sidewall 214B of the casing body 211, and can extend generally along the axis X1 from the sidewall 214B toward the opening 214A. According to an example of construction, the tongue 213 can include a support base 215 and two locking portions 217A and 217B. The support base 215 can exemplary have a plate shape. The support base 215 can be connected with the sidewall 214B of the casing body 211, and can extend from the sidewall 214B along the axis X1 toward the opening 214A.

The two locking portions 217A and 217B may have a same construction. More specifically, the two locking portions 217A and 217B and an end of the support base 215 distant from the sidewall 214B can be connected with one another via a joining part 218. The two locking portions 217A and 217B can stretch along the axis X1 symmetric to each other, and can respectively extend past the sidewall 214B into the two inner cavities 212. In particular, each of the two locking portions 217A and 217B may terminate into a free end 2171 that is at least partially positioned in the corresponding inner cavity 212. As shown in FIGS. 8 and 9, the two locking portions 217A and 217B can form a generally U-shaped structure. A gap may be defined between the support base 215 and each of the locking portions 217A and 217B, this gap extending along the axis X1 from the joining part 218 to the free end 2171. Moreover, a gap can be defined between each of the sidewalls 214C, 214D and 214E of the casing body 211 and the tongue 213 comprised of the support base 215 and the locking portions 217A and 217B. Accordingly, the locking portion 217A of the tongue 213 can elastically deflect toward and away from the sidewall 214C of the casing body 211 relative to the support base 215 for engaging and disengaging the strap fastener 230. Likewise, the locking portion 217B of the tongue 213 can elastically deflect toward and away from the sidewall 214D of the casing body 211 relative to the support base 215 for engaging and disengaging the strap fastener 230.

Referring to FIGS. 8 and 9, each of the locking portions 217A and 217B may further include a notch 2173 located between the free end 2171 and the joining part 218 along the axis X1. Each notch 2173 can respectively engage with the strap fastener 230 for preventing the strap fastener 230 from detaching from the strap fastener 210.

According to an example of implementation, the tongue 213 comprised of the support base 215 and the locking portions 217A and 217B may be formed integrally as a single part that is connected with the casing body 211. According to an example of implementation, the casing body 211, and the tongue 213 comprised of the support base 215 and the locking portions 217A and 217B, may be formed integrally as a single part.

Referring to FIGS. 8 and 9, the casing body 211 can further include a strap slot 2112 through which a strap portion may be wrapped and anchored to the strap fastener 210. The strap slot 2112 may be placed adjacent to the opening 214A of the casing body 211.

Referring to FIGS. 6-10, each of the two release actuators 250A and 250B may be provided as a release button 251. The two release actuators 250A and 250B can be respectively received at least partially in the two inner cavities 212 of the casing body 211, and can be respectively exposed for operation through two opposite openings 212A on the sidewalls 214C and 214D. For convenient access and operation, the two release actuators 250A and 250B may be exemplary disposed adjacent to an end of the casing body 211 that is opposite to that where is provided the opening 214A. The two release actuators 250A and 250B are movably assembled with the casing body 211, and can respectively contact and push against the free ends 2171 of the locking portions 217A and 217B so as to urge the locking portions 217A and 217B to deflect and disengage from the strap fastener 230.

According to an example of construction, the release actuator 250A may be assembled with the casing body 211 for sliding along an axis X2, which can be substantially perpendicular to the axis X1 of the tongue 213. The release actuator 250A can include a driving surface 2514 that faces the free end 2171 of the locking portion 217A. During operation, the release actuator 250A is movable along the axis X2 to cause the driving surface 2514 to contact and push against the free end 2171 and thereby urge the locking portion 217A to elastically deflect away from the sidewall 214C of the casing body 211 for disengaging from the strap fastener 230.

According to an example of construction, a sliding connection can further be provided between the locking portion 217A and the release actuator 250A. For example, the free end 2171 of the locking portion 217A can have a notch 2172, and the release actuator 250A can have a rib 2513 in sliding contact with the notch 2172. This sliding connection may assist in guiding the deflecting movement of the locking portion 217A.

Referring again to FIGS. 8 and 9, the spring 253A can be respectively connected with the release actuator 250A and a sidewall 2114 of the casing body 211. For facilitating the assembly of the spring 253A, the release actuator 250A may include a passage 2511 in which the spring 253A can be at least partially received. The spring 253A can bias the release actuator 250A for protruding outside the casing body 211 on the side of the sidewall 214C. Moreover, the release actuator 250A can have a stop rib 2512 that can contact against an edge 2121 of the inner cavity 212 to stop the release actuator 250A in position against the biasing force applied by the spring 253A.

The release actuator 250B can have the same construction as the release actuator 250A described above, and can be operatively connected with the locking portion 217B of the tongue 213 in the same manner. An assembly structure similar to that of the spring 253A with the release actuator 250A can be used for connecting the spring 253B with the release actuator 250B, the spring 253B being operable to bias the release actuator 250B for protruding outside the casing body 211 on the side of the sidewall 214D.

Referring to FIGS. 8 and 9, the strap fastener 230 can be formed integrally as a unitary part. According to an example of construction, the strap fastener 230 can include a support frame 230A having a receiving cavity 230B. The receiving cavity 230B can be delimited at least partially by a bottom plate 231 and a plurality of sidewalls 232 projecting from the bottom plate 231, and can be respectively opened at a side of the strap fastener 230 via an insert hole 233 and on a surface 236 of the support frame 230A via an opening 237. The tongue 213 of the strap fastener 210 can be inserted into the receiving cavity 230B via the insert hole 233 with the bottom plate 231 of the strap fastener 230 restrictedly positioned between the tongue 213 and the sidewall 214E of the strap fastener 210. Moreover, two opposite sidewalls 232 can respectively have two protrusions 234 adapted to engage with the notches 2173 provided on the two locking portions 217A and 217B for locking the strap fastener 210 with the strap fastener 230.

Referring to FIGS. 8 and 9, the support frame 230A can further include two strap slots 235 through which two strap portions may be respectively wrapped and anchored with the strap fastener 230. The two strap slots 235 can be disposed at two opposite sides of the receiving cavity 230B.

Exemplary operation of the harness fastening system 200 is described hereinafter with reference to FIGS. 6-10. For attaching the strap fastener 210 to the strap fastener 230, the tongue 213 of the strap fastener 210 can be inserted through the insert hole 233 into the receiving cavity 230B of the strap fastener 230. As the tongue 213 slides into the receiving cavity 230B, the bottom plate 231 of the strap fastener 230 can be positioned between the tongue 213 and the sidewall 214E of the strap fastener 210, and the protrusions 234 on the two sidewalls 232 can respectively push the two locking portions 217A and 217B of the tongue 113 to deflect toward each other and respectively away from the sidewalls 214C and 214D. Once the protrusions 234 reach the notches 2173, the locking portions 217A and 217B can elastically deflect away from each other and respectively toward the sidewalls 214C and 214D so that the protrusions 234 respectively engages the notches 2173 for locking the strap fastener 210 with the strap fastener 230. Owing to the biasing force of the springs 253A and 253B, the two release actuators 250A and 250B can protrude outward at two opposite sides of the strap fastener 210 when the strap fasteners 210 and 230 are attached to each other. After the strap fasteners 210 and 230 are attached to each other, the strap slot 2112 of the strap fastener 210 and the two strap slots 235 of the strap fastener 230 can be positioned along the same axis X1. Moreover, the support frame 230A of the strap fastener 230 can at least partially cover the inner cavity 214 of the strap fastener 210 and stretch over the two sidewalls 214C and 214D of the casing body 211.

For detaching the strap fastener 210 from the strap fastener 230, a user can respectively push the two release actuators 250A and 250B inward against the biasing force of the springs 253A and 253B. As a result, the two release actuators 250A and 250B can urge the two locking portions 217A and 217B of the tongue 213 to deflect toward each other and respectively away from the sidewalls 214C and 214D of the casing body 211, which thereby disengages the protrusions 234 from the notches 2173. The strap fasteners 210 and 230 can be thereby unlocked and pulled away from each other.

Advantages of the structures described herein include the ability to provide a harness fastening system that is convenient to operate, compact in size, and can attach two strap fasteners in an effective manner.

Realization of the harness fastening system has been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A harness fastening system comprising:

a first strap fastener; and a second strap fastener attachable to and detachable from the first strap fastener, wherein the second strap fastener comprises:

a casing body having an opening for passage of the first strap fastener;

a tongue disposed in the casing body, the tongue comprising a support base and at least one locking portion connected with each other, the support base being further connected with the casing body, the locking portion being elastically deflectable relative to the support base for engaging and disengaging the first strap fastener, the locking portion being engaged with the first strap fastener when the first and second strap fasteners are attached to each other, and the locking portion being disengaged from the first strap fastener when the first strap fastener is detached from the second strap fastener; and a release actuator movably assembled with the casing body, the release actuator being operable to urge the locking portion to elastically deflect for disengaging from the first strap fastener;

wherein the first strap fastener comprises a support frame having a receiving cavity delimited at least partially by a bottom plate and a plurality of sidewalls projecting from the bottom plate, the receiving cavity being opened on a surface of the support frame, the support frame further having a first and a second strap slot respectively disposed at two opposite sides of the receiving cavity, the tongue being inserted into the receiving cavity and the support frame covering at least partially an inner cavity of the casing body when the first and second strap fasteners are attached to each other.

2. The harness fastening system according to claim 1, wherein the support base of the tongue is connected with a sidewall of the casing body, and the locking portion is connected with the support base at an end of the support base distant from the sidewall of the casing body and extends past the sidewall of the casing body.

3. The harness fastening system according to claim 2, wherein the sidewall of the casing body faces the opening, and the support base of the tongue extends from the sidewall of the casing body along a first axis toward the opening, the first strap fastener being movable along the first axis through the opening into the casing body.

4. The harness fastening system according to claim 3, wherein the second strap fastener has a third strap slot, the first and second strap slots of the first strap fastener and the third strap slot of the second strap fastener are positioned along the first axis when the first and second strap fasteners are attached to each other.

5. The harness fastening system according to claim 3, wherein the release actuator is assembled with the casing body for sliding movement along a second axis substantially perpendicular to the first axis.

6. The harness fastening system according to claim 1, wherein the opening is provided at a first end of the casing body, and the release actuator is disposed adjacent to a second end of the casing body opposite to the first end.

7. The harness fastening system according to claim 1, wherein the locking portion has a free end, the release actuator being operable to contact and push against the free end to cause the locking portion to deflect relative to the support base for disengaging from the first strap fastener.

8. The harness fastening system according to claim 7, wherein the release actuator has a ramp surface, and the release actuator urges the locking portion to deflect relative to the support base for disengaging from the first strap fastener via a sliding contact between the ramp surface and the free end.

9. The harness fastening system according to claim 1, wherein the opening has a width that is defined between two opposite sidewalls of the casing body, and the release actuator is exposed on one of the two opposite sidewalls of the casing body.

10. The harness fastening system according to claim 1, further comprising a spring respectively connected with the casing body and the release actuator, the spring biasing the release actuator for protruding outside the casing body.

11. The harness fastening system according to claim 1, wherein the locking portion has an opening or a notch, and the first strap fastener has a protrusion that engages with the opening or the notch of the locking portion when the first strap fastener is attached to the second strap fastener.

12. The harness fastening system according to claim 1, wherein the casing body has a third strap slot adjacent to the opening.

13. The harness fastening system according to claim 1, wherein the tongue comprised of the support base and the locking portion is formed integrally as a single part.

14. The harness fastening system according to claim 1, wherein the casing body, and the tongue comprised of the support base and the locking portion, are formed integrally as a single part.

15. The harness fastening system according to claim 1, wherein the at least one locking portion include two locking portions that form a generally U-shaped structure.

16. The harness fastening system according to claim 15, wherein the two locking portions and an end of the support base are connected with one another via a joining part.

17. The harness fastening system according to claim 1, wherein the bottom plate is restrictedly positioned between the tongue and a sidewall of the casing body when the first and second strap fasteners are attached to each other.

18. A harness fastening system comprising:

a first strap fastener; and a second strap fastener attachable to and detachable from the first strap fastener, wherein the second strap fastener comprises:

a casing body having an opening for passage of the first strap fastener;

a tongue disposed in the casing body, the tongue comprising a support base and at least one locking portion connected with each other, the support base being further connected with the casing body, the locking portion being elastically deflectable relative to the support base for engaging and disengaging the first strap fastener, the locking portion being engaged with the first strap fastener when the first and second strap fasteners are attached to each other, and the locking portion being disengaged from the first strap fastener when the first strap fastener is detached from the second strap fastener; and a release actuator movably assembled with the casing body, the release actuator being operable to urge the locking portion to elastically deflect for disengaging from the first strap fastener;

wherein the first strap fastener comprises a support frame having a receiving cavity delimited at least partially by a bottom plate and a plurality of sidewalls projecting from the bottom plate, the support frame further having a first and a second strap slot respectively disposed at two opposite sides of the receiving cavity, the tongue being inserted into the receiving cavity when the first and second strap fasteners are attached to each other.

19. The harness fastening system according to claim 18, wherein the first strap fastener further includes a protrusion in the receiving cavity, and the locking portion has an opening or a notch, the tongue being insertable into the receiving cavity so that the protrusion engages with the opening or the notch of the locking portion to attach the first and second fasteners.

20. The harness fastening system according to claim 18, further comprising a spring respectively connected with the casing body and the release actuator, the spring biasing the release actuator for protruding outside the casing body.

* * * * *